United States Patent [19]

Ezoe

[11] 4,312,144

[45] Jan. 26, 1982

[54] MULTI-BLADE DITCHING MACHINE

[75] Inventor: Takuji Ezoe, 7-14, Tsukushino 2-chome, Machida-shi, Tokyo, Japan

[73] Assignee: Takuji Ezoe, Tokyo, Japan

[21] Appl. No.: 91,482

[22] Filed: Nov. 5, 1979

[51] Int. Cl.[3] ..... E02F 5/02

[52] U.S. Cl. ..... 37/98; 37/54; 405/159

[58] Field of Search ..... 37/193, 98, 54; 172/382, 700, 756; 405/159, 164, 165

[56] References Cited

U.S. PATENT DOCUMENTS

| | | | |
|---|---|---|---|
| 2,358,495 | 9/1944 | Pace | 37/98 |
| 2,569,556 | 10/1951 | Collins et al. | 172/700 |
| 2,667,710 | 2/1954 | Settlemire | 37/98 |
| 3,190,368 | 6/1965 | Van der Lely | 172/756 |
| 4,053,998 | 10/1977 | Ezoe | 405/159 X |
| 4,102,407 | 7/1978 | Danszky et al. | 172/700 X |

FOREIGN PATENT DOCUMENTS

| | | | |
|---|---|---|---|
| 52-13685 | 2/1977 | Japan | 405/164 |

*Primary Examiner*—Clifford D. Crowder

*Attorney, Agent, or Firm*—Armstrong, Nikaido, Marmelstein & Kubovcik

[57] ABSTRACT

A ditching machine for digging a ditch or a trench for submarine cables having at least several plurality pairs of blades disposed along the longitudinal direction of the center body of the machine. At least the blades in the forward position have a ditching portion which ditches soil, and a soil-pushing portion which pushes away the soil thus ditched substantially and horizontally in a direction lateral to the moving direction of the ditching machine. Said soil-pushing portion is at the top of said ditching portion and has a wider horizontal width as seen from front of the ditching machine than that of said ditching portion when the ditching machine is in a normal operating position. Further, at least a part of the edge of the pair of extreme ends of said soil-pushing portion are cut slantwise so that the pair of said edges of each blade open upwardly, and said center body has a plurality of small holes at the bottom of the same towards the back portion of each blade, thus, the soil ditched from the trench does not drop back down into the trench, then the towing tension of the towing wire between the ditching machine and the work ship is considerably reduced.

2 Claims, 10 Drawing Figures

MULTI-BLADE DITCHING MACHINE

BACKGROUND OF THE INVENTION

The present invention relates to a multi-blade ditching machine or a trencher which is used for burying submarine cables or the like in the sea floor and/or for pulling them above the water surface, and more particularly to an improvement in blades of a multi-blade ditching machine.

To protect submarine cables or the like from fishing tools, it has been the practice in many countries of the world to bury the cables or the like in the sea floor and to pull out such buried cables or the like by ditching a ditch for repair in case of faults. For this purpose, ditching machines which ditch the soil or sediment of the sea floor to a desired depth have been used, and such ditching machines are called cable-buriers or cable-searchers depending on the purpose thereof.

Although the structure of the cable-buriers is somewhat different from that of the cable-searchers due to the difference in their pusposes, the essential ditching portions of both the cable buriers and cable-searchers are similar to each other, and such ditching portions use water jets or plows for ditching trenches on the sea floor. Conventionally, two types of ditching portions with plows have been used, i.e., single-blade type ditching portions and multi-blade type ditching portions.

The present invention relates to a multi-blade plow type ditching machine or trencher.

In order to facilitate the easy understanding of the present invention, a prior plow type multi-blade trencher will be described in accordance with FIGS. 1 through 4. That prior art is shown in U.S. Pat. No. 4,053,998, and U.K. Pat. No. 1,477,815.

FIG. 1 shows a cable ship under the operation of laying a submarine cable. In the figure, the reference numeral 100 shows a ditching machine or a trencher, 101 is the sea bottom, 102 is the trench thus dug, 103 is the communication cable to be laid, 104 is a wire for towing a trencher by a cable ship or a work ship, 105 is a work ship, 106 is a sea surface. As the work ship 105 tows the trencher 100 through the towing wire 104, the trench 102 is provided on the seabottom, and the cable 103 is laid and buried in said trench.

FIGS. 2 and 3 show the prior ditching machine, and FIG. 4 is a schematic diagram illustrating the relation between the blade arrangement of the ditching machine in FIGS. 2 and 3. In FIGS. 2 and 3, the reference numeral 1 is the stabilizing wing, 2 is the center body, 2*a* is the side plate connected to said center body, 3 is a joint between the stabilizing wing and the center body, $\mathbf{5}_1$ through $\mathbf{5}_n$ are blades for digging a trench and pushing away the ditched soil. In the embodiment shown in FIGS. 2 and 3, there are seven blades and so $n=7$. Also the reference numeral 6 is a towing wire (corresponding to 104 in FIG. 1), 7 is the cable inlet, 8 is the bottom of the trench thus dug, 9 is a cable to be buried, 10 is a communication repeater inserted between the cables, 13 is a rotational axis of a pushing roller, 14 is a frame of a pushing roller, 15 is a pushing roller, 18 is a second small roller, 19 is a tail roller, and 20 is a guide for the pushing roller 15.

The ditching machine or the trencher shown in FIGS. 2 and 3 is towed by the work ship by the towing wire 6, and digs the seabottom by the depth H from the level $S_1$ to the level $S_2$ utilizing the blades $\mathbf{5}_1$ through $\mathbf{5}_n$. The cable and the repeaters taken off from the work ship are laid in the trench thus dug through the center body 2 of the trencher. The stabilizing wing 1 of the trencher functions to stabilize the posture of the trencher on the seabottom, and the pushing roller 15 pushes the cable to the bottom of the trench by the weight of the roller 15 itself. So the cable is taken off through the path between the pushing roller 15 and the second small roller 18 to the trench bottom 8. The trail roller 19 is utilized when a cable is not buried but is merely put on the seabottom. When only the trail roller 19 is used, the ditching machine is lifted on the deck of the work ship and is placed in the upside-down on the deck of the work ship. The cable 9 is then taken off through said trail roller 19 to the seabottom.

FIG. 4 shows the front view of the arrangement of the blades $\mathbf{5}_1$ through $\mathbf{5}_n$, and for the sake of the simple explanation only the right half of the blades are shown in the drawing. Of course the left half of the blades is symmetrical with the right half. At first, the first blade $\mathbf{5}_1$ ( (1)-(1) ) digs the wide ( width $W_1$) and shallow (depth $d_1$) trench, which is deepened by the succeeding blades $\mathbf{5}_2$ through $\mathbf{5}_n$. When the last blade $\mathbf{5}_7$ digs the trench, said trench has the width $W_7$ and the depth $(d_1+d_2+d_3+d_4+d_5+d_6+d_7)$. It should be appreciated in FIG. 4 that the actual digging of the trench is accomplished by the ditching portion at the center of the blades and the excavated soil is placed on the outer space of the trench thus dug by the soil pushing portion at the top of each blade.

However, the prior ditching machine shown in FIGS. 1 through 4 has the disadvantages that the excavated soil has the tendency to be dropped down again in the trench which has just been dug, because of the shape of each blade and the low pressure generated behind each blade. Then the towing tension of towing wire becomes extremely high, and increased towing power of the work ship is required.

SUMMARY OF THE INVENTION

It is an object, therefore, of the present invention to overcome the disadvantages and limitations of a prior ditching machine by providing a new and improved multi-blade plow type ditching machine, in which the excavated soil from the trench does not drop down into the trench, and the towing tension of the towing wire is extremely reduced.

The above and other objects are attained by a multi-blade ditching machine comprising of a stabilizing wing, an elongated hollow center body connected bendably in an up and down direction to said stabilizing wing, a plurality of blades disposed along said center body at the predetermined intervals, the blades which are positioned at the rear portion of said ditching machine having a greater vertical length and smaller horizontal extent transverse to the direction of movement than the more forwardly disposed blade and adapted to ditch more deeply with narrower ditching widths, at least two of the most forward of the blades having a ditching means for ditching soil and a soil-pushing means for pushing said soil substantially horizontally in a direction lateral to moving direction of the ditching machine, the soil-pushing means being at the top of said ditching means and having a wider horizontal width as seen from the front of the ditching machine than that of said ditching means when the ditching machine is in a normal operating position, at least a part of the edge of the pair of extreme ends of at least one of said soil-pushing means being inclined so that the pair of said edges of each blade are cut slantwise, and said center body having a plurality of small holes at the bottom of the same towards the back portion of each blade.

BRIEF DESCRIPTION OF THE DRAWINGS

The foregoing and other objects, features, and attendant advantages of the present invention will be more highly appreciated as the same become better understood by means of the following description and accompanying drawings wherein.

DESCRIPTION OF THE PREFERRED EMBODIMENTS

Figure 1:
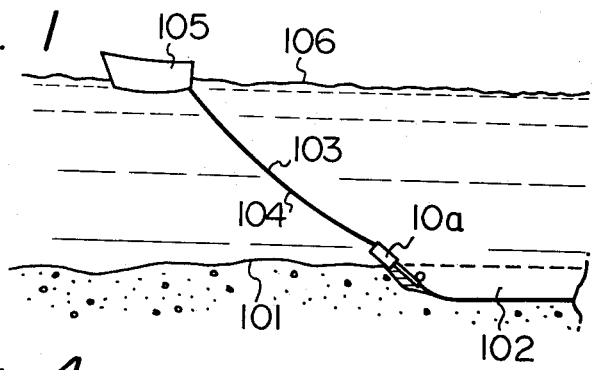
FIG. 1 shows the explanatory drawing for laying a cable in a trench.
Figure 4:
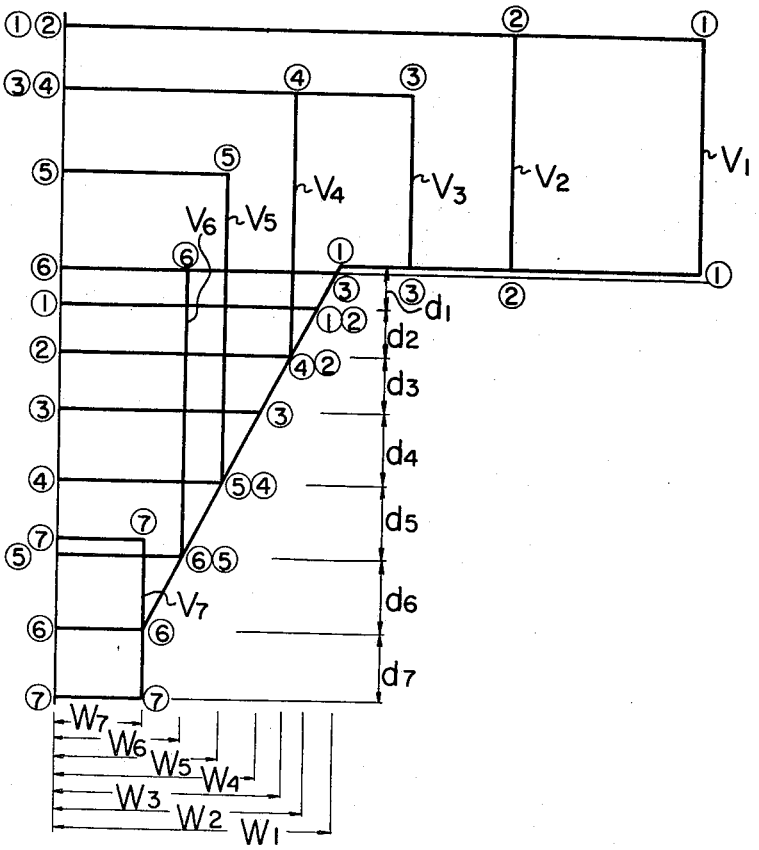
FIG. 4 is a schematic diagram illustrating the relation between the blade arrangement of the conventional ditching machine shown in FIGS. 2 and 3.
Figure 2:
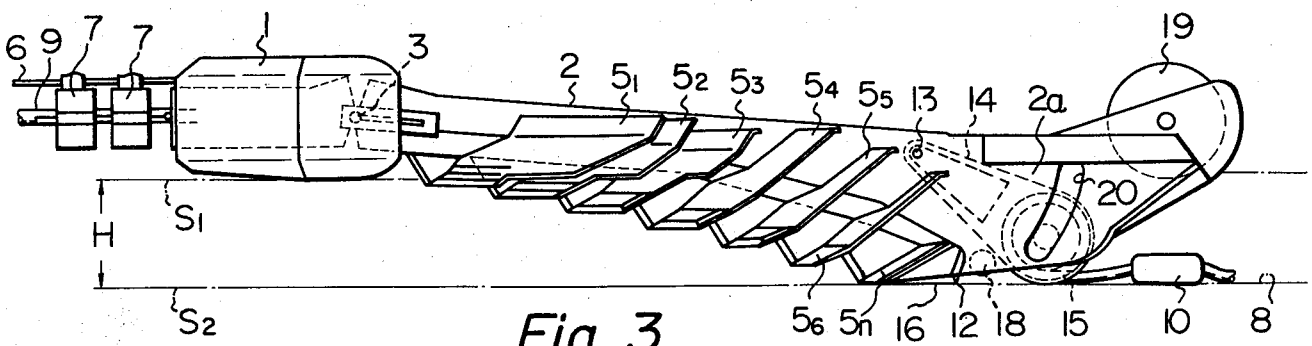
FIG. 2 is the vertical view of the prior ditching machine.
Figure 3:
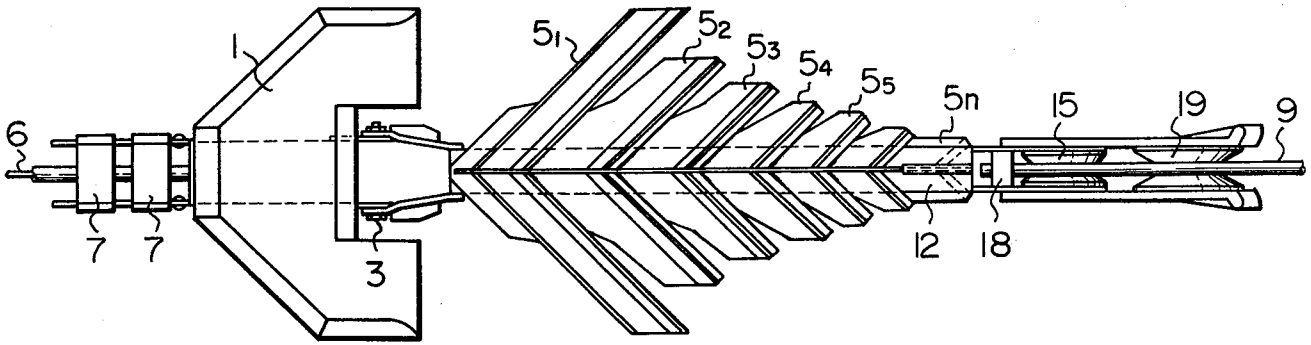
FIG. 3 is the plan view of the ditching machine in FIG. 2.
Figure 5:
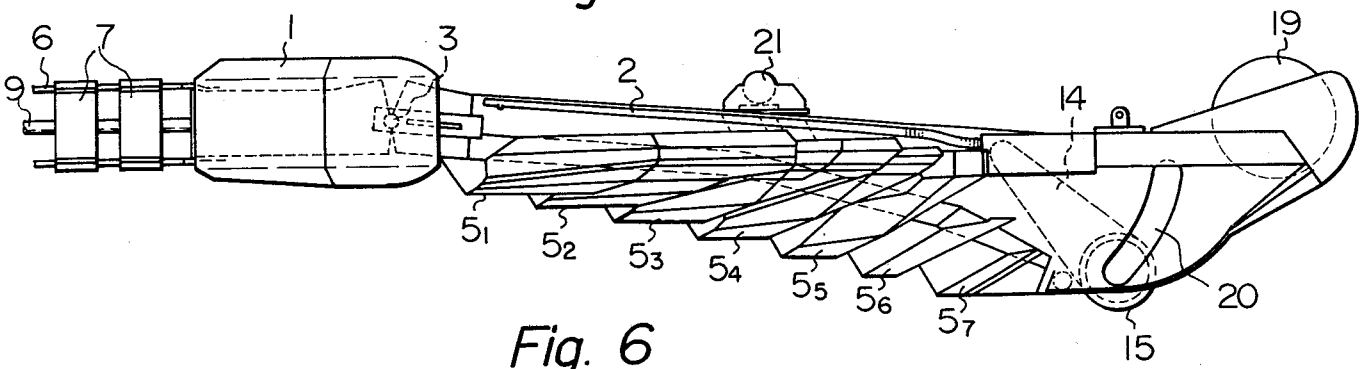
FIG. 5 is the vertical view of the ditching machine according to the present invention.
Figure 6:
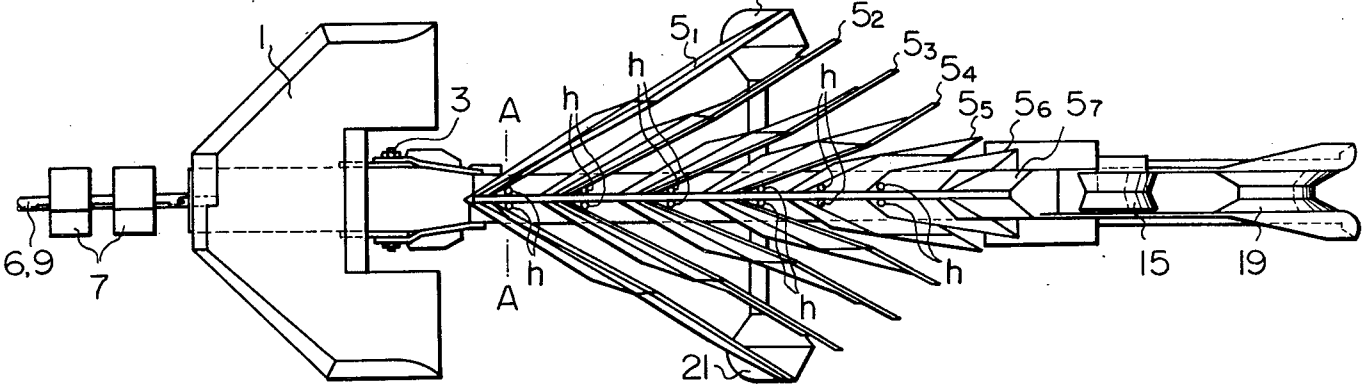
FIG. 6 is the plan view of the ditching machine according to the present invention.
Figure 7:
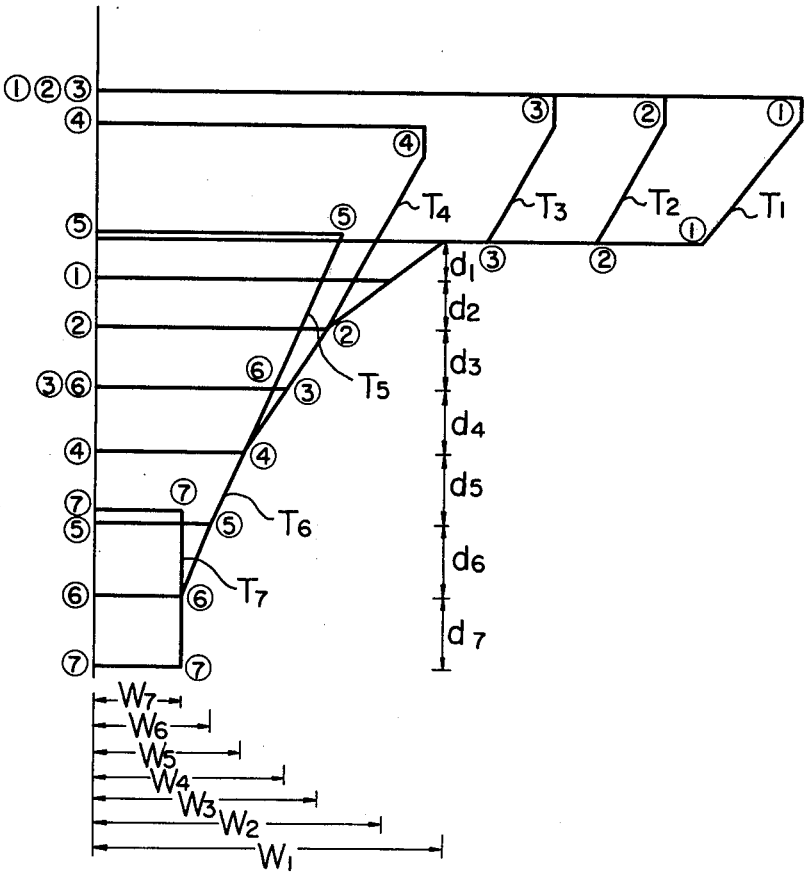
FIG. 7 is a schematic diagram illustrating the relation between the blade arrangement of the present ditching machine.
Figures 8A, 8B:
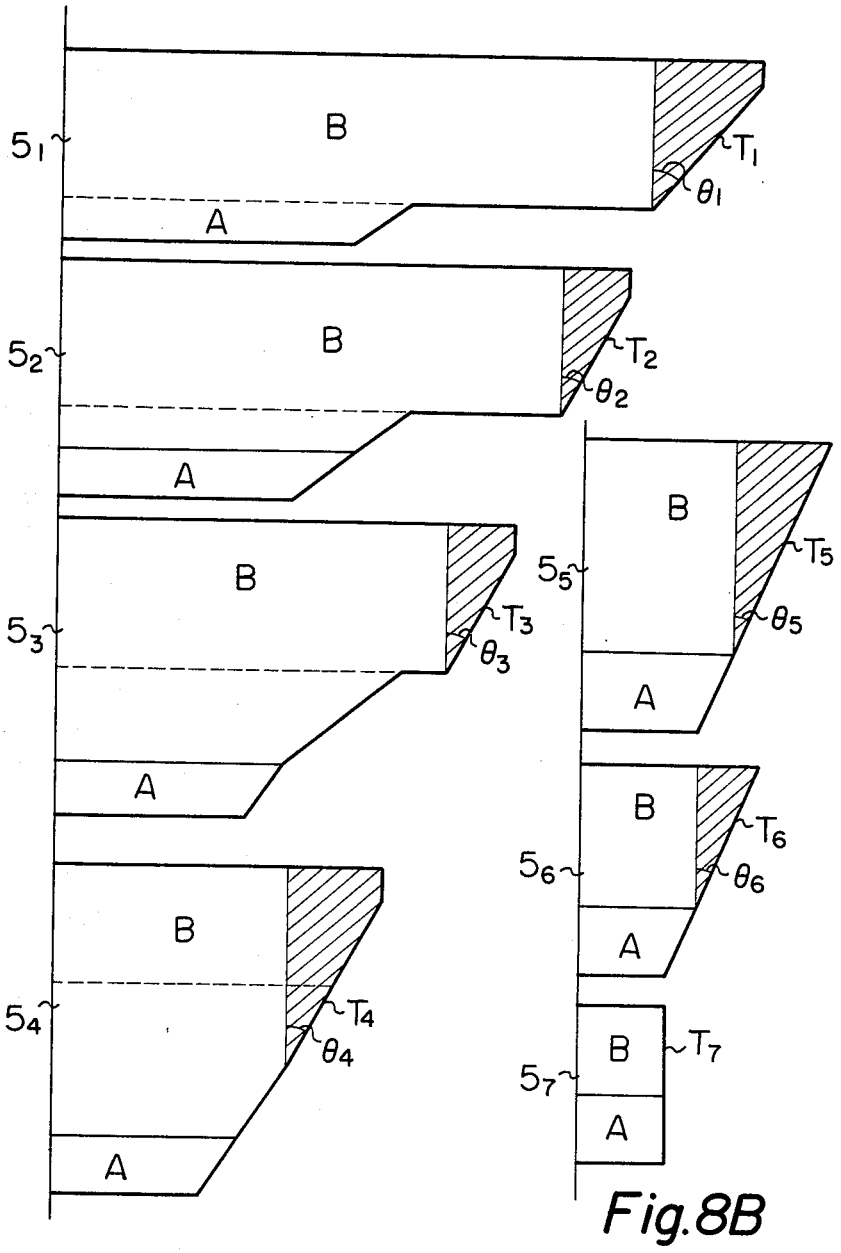
FIGS. 8A and 8B show separately each blade shown in FIG. 7.

FIG. 5 is the vertical view of the ditching machine according to the present invention. FIG. 6 is the plane view (from the bottom) of the ditching machine according to the present invention, and FIG. 7 shows the front view of the right half of the blades according to the present invention. It should be appreciated that FIG. 7 is the combination of the blades shown in FIG. 8.

Figure 9:
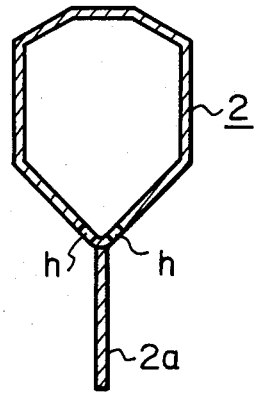
FIG. 9 is the cross sectional view at the line A—A of FIG. 6.

FIG. 9 is the cross sectional view of the ditching machine shown in FIGS. 5 and 6, but FIG. 9 shows only the center body 2 and the protection board 2*a* extending beneath said center body 2.

In those figures, the same reference numerals as those in FIGS. 1 through 4 show the same members as those in the latter. In FIG. 6, the reference numeral 21 is a caster, which facilitates the transportation of the ditching machine on the deck of the work ship, which lowers down and lifts up the ditching machine to and from the seabottom.

In FIGS. 5 through 9, the reference numeral 1 is the stabilizing wing for providing the horizontal position to the ditching machine. The elongated hollow center body 2 is jointed to the wing 1. The center wing 2 can bend up and down at the coupling point with the wing 1. A plurality of pairs of blades $5_1$ through $5_n$ are disposed along the center body 2 at the predetermined intervals. The blades which are positioned at the rear portion of said ditching machine like $5_6$ or $5_7$ have a greater vertical length and smaller horizontal extent transverse to the direction of movement than the more forwardly disposed blades like $5_1$ or $5_2$, and the blades are adapted to ditch more deeply with narrower ditching widths. At least the two most forward of the blades have a ditching portion (see A in FIGS. 8A and 8B) for ditching soil and a soil-pushing portion (see B in FIGS. 8A and 8B) for pushing said soil substantially horizontally in a direction lateral to moving direction of the ditching machine. As apparent from the drawings, a soil-pushing portion is at the top of a ditching portion and has a wider horizontal width as seen from the front of the ditching machine than that of said ditching portion when the ditching machine is in a normal operating position. In the embodiment, the blades $5_1$ through $5_7$ have both said ditching portion (A) and said soil-pushing portion (B) as shown in FIGS. 8A and 8B. And, the portion shaded as shown in FIGS. 8A and 8B is attached to the extreme end of the soil-pushing portion B. It should be noted that in the blades $5_1$ through $5_6$ the side end of said shaded portion is cut slantwise, and the slant side is one of the features of the present invention.

In FIG. 8, concerning blades $5_1$, $5_2$, $5_3$ and $5_4$, the dotted line in the portion (B) shows the line of the sea-surface. Accordingly, the soil ditched by the blades $5_1$ through $5_3$ is put on the sea-surface, the soil ditched by the blade $5_4$ is put on both the sea-surface and the trench thus ditced, and the soil ditched by the blades $5_5$ through $5_7$ is put in the trench which is ditched by the preceding blades.

In the operation, the ditching portions of the blades dig a trench as the ditching machine is plowed through the towing wire by the work ship, and the soil thus dug is pushed away horizontally in a direction lateral to the moving direction of the ditching machine.

One of the features of the ditching machine according to the present invention is that at least a part of the side edge of the soil-pushing portion of each blade is slanted concerning the vertical line so that a pair of side edges open upwardly. In the embodiment, the side edges $T_1$ through $T_6$ of the blades $5_1$ through $5_6$ are cut slantwise. The angles $\theta_1$ through $\theta_6$ between the edges $T_1$ through $T_6$ and the vertical line are preferably approximately the same as the angle of repose of the excavated soil, which is the necessary angle to prevent the soil from slipping. The edge of the most rear blade $5_7$ is not cut slantwise. Accordingly, the front view of each soil-pushing portion is approximately in a trapezoid shape.

It should be noted that the amount of the soil ditched by the forward blade and slipped into the space made by the forward blade is decreased as the angle $\theta$ is increased. Then, the larger the angle $\theta$ is, the better for preventing the slipping of the soil. However, said angle $\theta$ is enough if the angle is approximately 40 degrees. On the other hand, if the angle $\theta_5$ or $\theta_6$ of the rear blades is large, the width of the ditching machine itself is undesirably increased. Accordingly, in the preferable embodiment, the angles are designed so that $\theta_1$ through $\theta_4$ is 40°, and $\theta_5$ and $\theta_6$ is 20°. With the above slanted angles, the towing tension can be reduced to $\frac{2}{3}$ of that of a prior ditching machine, while keeping a small size of a ditching machine.

On the other hand, in the prior ditching machine shown in FIG. 1 through 4, the corresponding edges ($V_1$ through $V_7$ in FIG. 4) are vertical in the front view when the ditching machine is in a normal operating position, and so the soil excavated and pushed away by the forward blade is dropped back down in the trench, and the trench just dug is covered up. Further, the dropped soil is again dug by the succeeding blades, therefore, the load of the trencher is increased.

Although the embodiment shows the slant edges of the blades $5_1$ through $5_6$, it should be noted that it is effective when at least the edge of one blade is cut slantwise.

Another feature of the present ditching machine is the presence of a plurality of small holes (h) at the bottom of the center body towards the back of each blade. The effect of those holes is as follows.

When a prior ditching machine ditches soil, the back area of each blade experiences a low pressure condition or a vacuum condition. The low pressure increases the towing tension of the work ship, prevents the soil to be pushed away by the blade, and further drops the soil excavated by the preceding blades. According to the present invention, sea water is supplied through said small holes (h) on the center body to the back portion of each blade, then, said low pressure or vacuum condition at the back portion of each blade is cancelled, and so the increase of tension on the towing wire is prevented and also the dropping down of the excavated soil is prevented. The water for flowing in said holes is introduced in the center body from the opening of the joint 3, and it should be noted that said holes are provided so that said water is released after said water is introduced near the back portion of the ditching portion of the preceding blade.

According to our experiment, the area of each hole (h) is preferably 50 $cm^2$ for providing the satisfactory effect.

The modification of said small hole is possible. For instance, said small hole can be provided on each blade itself, instead of on the center body. In that case, the water at the front portion of a blade is introduced through the small hole to the back portion of the blade.

As explained above in detail, the present ditching machine has the features that the side ends of the soil pushing portion of each blade is cut slantwise with the angle approximate equal to the angle of repose (about 40°) of the soil, and that small holes are provided in order to introduce water to the back portion of each blade. Accordingly, the excavated soil does not drop down back into the trench, and the towing tension experienced by the work ship is extremely reduced.

The present ditching machine is utilized not only for the ditching machine for a submarine communication cable, but also for any ditching machine having multi-blades.

From the foregoing it should now be apparent that a new and improved ditching machine has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A multi-blade ditching machine comprised of a stabilizing wing, an elongated hollow center body movably connected to said stabilizing wing, said center body being movable in the vertical direction with respect to said stabilizing wing, a plurality of blades disposed along said center body at predetermined intervals, the blades which are positioned at the rear portion of said ditching machine having a greater vertical length and smaller horizontal extent transverse to the direction of movement than the more forwardly disposed blades and adapted to ditch more deeply with narrower ditching widths, wherein said center body has a plurality of small hole means at the bottom thereof positioned towards the back portion of each blade, for permitting the flow of water to the rear of the blade, thereby increasing the pressure at the rear thereof, wherein at least the two most forward of the blades have a ditching means for ditching soil and a soil-pushing means for pushing said soil substantially horizontally in a direction transverse to the moving direction of the ditching machine, the soil-pushing means being at the top of said ditching means and having a wider horizontal width as seen from front of the ditching machine than that of said ditching means when the ditching machine is in a normal operating position, and wherein at least a portion of the edge of the extreme side ends of at least one of said soil-pushing means forms an acute angle with respect to the vertical and the vertex of the angle is below the upper edge of the soil pushing means.

2. A multi-blade ditching machine according to claim 1, wherein the number of blades is seven, and soil-pushing portion is provided to all the blades except the most rear blade.

* * * * *